United States Patent [19]

Tonkel

[11] Patent Number: 4,805,321

[45] Date of Patent: Feb. 21, 1989

[54] REVERSIBLE SHOE TONGUE

[75] Inventor: Raymond F. Tonkel, St. Louis, Mo.

[73] Assignee: Kangaroos U.S.A., Inc., Chesterfield, Mo.

[21] Appl. No.: 108,434

[22] Filed: Oct. 14, 1987

[51] Int. Cl.[4] ..... A43B 23/26

[52] U.S. Cl. ..... 36/54; 36/100; 36/136

[58] Field of Search ..... 36/54, 136, 100, 101; D2/265, 275, 309

[56] References Cited

U.S. PATENT DOCUMENTS

| | | | |
|---|---|---|---|
| 1,253,777 | 1/1918 | Bromlet | 36/54 |
| 2,887,795 | 5/1959 | Taicher | 36/100 X |
| 4,372,060 | 2/1983 | Adamik | 36/54 |

FOREIGN PATENT DOCUMENTS

| | | | |
|---|---|---|---|
| 3144949 | 5/1983 | Fed. Rep. of Germany | 36/54 |
| 3337319 | 5/1984 | Fed. Rep. of Germany | 36/136 |
| 1535635 | 7/1968 | France | 36/101 |
| 23547 | of 1899 | United Kingdom | 36/54 |
| 1347424 | 2/1974 | United Kingdom | 36/136 |

*Primary Examiner*—James Kee Chi

*Attorney, Agent, or Firm*—Paul M. Denk

[57] ABSTRACT

A footwear of the type incorporating a shoe upper, attaching to a shoe sole, with a tongue portion connecting with the toe piece for the shoe upper, with the tongue portion being fabricated of either singular or a pair of liners of material, having hook and pile fastening means provided at its lower edge, and likewise at the upper edge of the toe piece, so that the tongue can be connected to the toe piece, but then readily removed and reversed, so as to disclose its opposite side where a variety of colors or indicia are desired for display during usage and application of the identified structured footwear.

8 Claims, 1 Drawing Sheet

REVERSIBLE SHOE TONGUE

BACKGROUND OF THE INVENTION

Various designs for footwear tongue or gusset portions, which are fabricated to achieve particular results, such as either being a tongue portion for underlying the laces engaging the footwear eyestay, a tongue that incorporates a shallow cavity therein, or even a tongue formed in the shape of a gusset, that attaches partially upwardly of the eyestay, for adding waterproofing attributes to the footwear, particularly a boot, have long been available in the art. For example, U.S. Pat. No. 4,372,060, to Adamik, discloses a construction of tongue for shoe or the like article, and wherein the tongue contains a shallow compartment along its length, for providing means for retention of items, such as the coins as shown, therein. Such a formed compartment also discloses a fold over portion, functioning as a closure element, and which is retained in closure by means of the shown fastening elements, which appear to be fabricated in the manner of a form of Velcro. In addition to the foregoing, the U.S. Pat. No. 143,392, to Barlow, shows a shoe tongue for a stroller type of footwear and which includes a designed pocket therein. A similar type of relationship is shown in the other Barlow U.S. Pat. No. D. 143,301.

In addition, the U.S. Pat. No. 601,192, to Woodside, discloses a tongue for boots or shoes, and which is formed as a flexible tongue having a front piece and backing piece, with elastic or flexible stuffing contained therein, to provide a more cushioned form of tongue for use in conjunction with boots or shoes, as identified. The U.S. Pat. No. 3,018,570, to Bliese, discloses a combined shoe and purse, wherein a purse portion is fabricated into the construction of the toe piece for the disclosed shoe. It appears that the pocket portion is integrated onto the toe cap as disclosed.

The U.S. Pat. No. 4,280,287, to Gulbransen, shows a pocket attached onto an athletic shoe, but it is not disclosed as being fabricated onto the tongue portion of the footwear itself. Similarly, the U.S. Pat. No. 4,296,557, to Gamm, shows a pocket part fabricated onto a quarter portion for footwear. The additional U.S. Pat. No. D. 271,157, to Gamm, discloses an athletic shoe with a pocket, wherein the pocket is formed in the fold over portion of the shoe gusset, or tongue, as can be noted. An additional U.S. Pat. No. 4,630,386, to Mr. Gamm, discloses the utility patent upon the shoe with gusset pocket development, disclosing a related type of pocket formed in the shoe gusset, and which folds over for overlying the lacing and eyestay for the disclosed athletic shoe. Finally, a further U.S. Pat. No. De. 281,925, to Gamm, discloses a pocket formed into the footwear gusset or tongue, and which is of one of the types as previously alluded to in the introductory portion of this background of the invention. All of the Gamm patents are owned by a common assignee to the invention herein disclosed.

These are examples of modifications made to the tongue or gusset of footwear, but the invention of this current development advances the utility of the footwear tongue one step further, in providing for its reversibility, so as to allow various indicia to be displayed, rather promptly, simply upon a turning of the tongue in its installation within the footwear structure, or for providing a disclosed pocket, or the reverse thereof, a concealed pocket, simply through the reversing of the shoe tongue during its application.

SUMMARY OF THE INVENTION

This invention relates principally to a tongue for footwear, and which is reversible at the selection of the wearer to provide a selection of two sides which may bear individual displays or indicia for disclosure during application of a pair of shoes.

This invention contemplates the fabrication of the standard footwear or shoe, and of the type which comprise either athletic shoes, jogging shoes, casual shoes, boots, and even the dress shoe, constructed incorporating the usual vamp, toe piece, quarter portions, and counters, all integrated together to form a shoe upper, and which are secured together to a shoe sole. In the preferred embodiment, the tongue portion for the shoe is fastened to the approximate upper edge of the toe piece, through the usage of any form of fastening means, but preferably the hook and pile style of fastening means generally identified and marketed in the trade under the trademark "Velcro". Thus, one part of the hook and pile fastening means connects preferably to the underside of the toe piece, along its upper edge, as explained, while the other component of the fastening means secures to both sides of the lower edge of the tongue portion for the footwear. Hence, the tongue can be secured to and by way of the fastening means with the toe piece, for displaying some indicia or coloring material upon its upper surface, but then can be reversed, to display the indicia provided upon the opposite surface of the said tongue portion. In addition, the tongue, of this design, and having this utility, can likewise be formed having an internal pocket, which can be either fabricated between a pair of liners forming the pocket, or where the tongue may be formed of an integral piece of material, polymer, or leather, the pocket may be formed as a laminate applied to one or both surfaces of the said footwear tongue.

In view of the foregoing, it is the principal object of this invention to provide a tongue portion for footwear and which may be reversible in its installation, being held in place generally through application of a hook and pile style of fastening means which renders the tongue readily removable, and reversible, in its installation and setting.

Another object of this invention is to provide a footwear tongue which provides a multitude of indicia, upon both of its upper and lower surfaces, and which either may be displayed through the manipulation and reversal of the tongue portion in its installation.

Another object of this invention is to provide a pocket within or upon the tongue portion of footwear, as previously described.

Still another object of this invention is to provide a reversible tongue, as for example for use in application in an athletic shoe, and wherein the tongue portion may be reversed, to display at least two different colors, during usage, where, for example, one color may be displayed in conjunction with usage of a home uniform, but the shoe may have its tongue reversed to display a different color, as when the travelling uniform is worn by the player.

These and other objects will become more apparent to those skilled in the art upon reviewing the description of the preferred embodiment set forth herein, in view of its drawings.

DESCRIPTION OF THE PREFERRED EMBODIMENT

Figure 1:
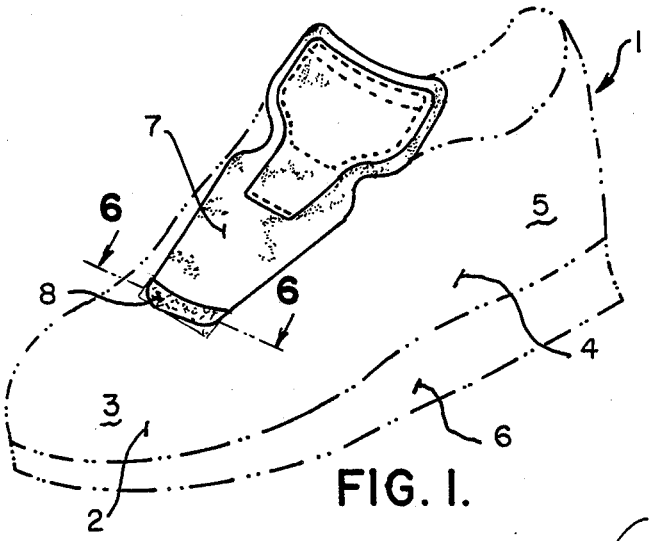
FIG. 1 is an isometric view showing in phantom line a shoe, with the reversible tongue pocket of this invention disclosed attaching thereto.
Figure 2:
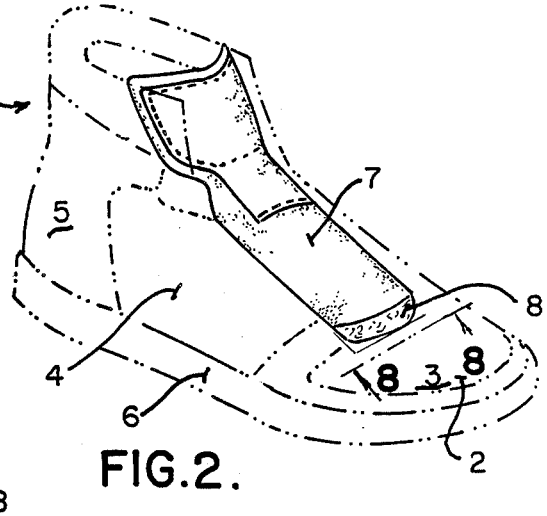
FIG. 2 is an isometric view of a shoe, shown in phantom line, with the reversible tongue invention being secured thereto.
Figure 3:
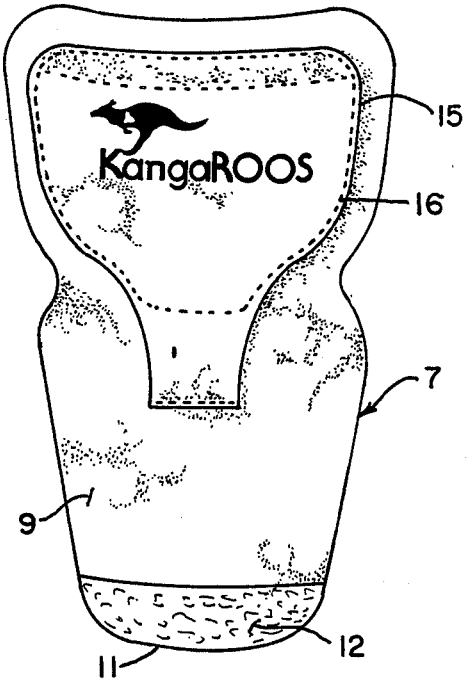
FIG. 3 is a top of the reversible shoe tongue of this invention.
Figure 4:
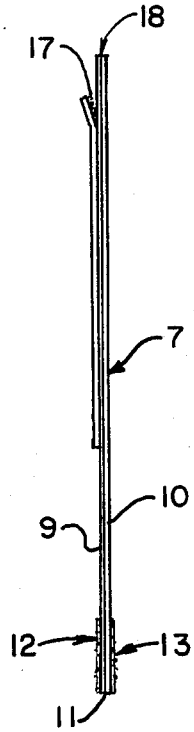
FIG. 4 is a right edge view thereof.
Figure 5:
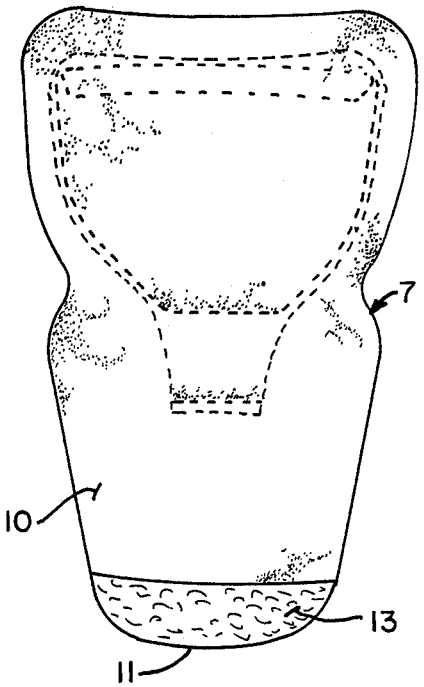
FIG. 5 is a bottom side view of the reversible shoe tongue of this invention.

In referring to the drawings, and in particular FIGS. 1 and 2, there are disclosed, in phantom line, a shoe upper, as at 1, being of the low cut style in one embodiment, and the high top style in the second embodiment, and which are generally fabricated from various components including a vamp, as at 2, a toe piece 3, quarter portions, as at 4, and a counter segments, as at 5, all of which are integrated together and secured to the footwear sole 6, as noted. In this invention, though, it is the application of a specially fabricated shoe tongue 7 to the shoe upper, and more particularly at the location of the upper edge of the toe piece 3, as at 8, which provides the essence of this invention. More specifically, as can be noted, as also in FIG. 3, the shoe tongues include either a singular or laminar piece of material that is fabricated into the shape of the shoe tongue 7, and such material may be, as previously described, either a fabric, a polymer, or leather, or the like. As shown in FIG. 3, in this particular embodiment, the tongue 7 is formed of a pair of liners, comprising the normally upper liner 9, and the lower liner 10 which are stitched together, or otherwise generally adhered together, in the fabrication of this shoe component. The proximate lower edge 11 of the tongue portion 7 includes one segment of a fastening means, such as the pile portion of a hook and pile type of fastening means, and which is applied to both surfaces of the approximate lower edge, as can be seen at 12 and 13. In addition, the approximate upper edge 8 of the toe piece 3 likewise includes the other element of such a fastening means, and in this particular instance, may comprise the hook portion 14 of the fastening means generally marketed under the trademark Velcro. See FIG. 7. Thus, as can be readily observed, the tongue portion for the footwear can be slid underneath of the upper edge of the toe piece, and adhered into position through engagement of the hook and pile fastening means together. On the other hand, since the pile means is likewise secured to the opposite lower edge of the tongue portion 7, the tongue can be readily removed, reversed in its emplacement, and adhered once again, together with the upper edge of the toe piece, at its underside or interior surface, so as to display the opposite or lower surface of the said tongue portion.

Figure 6:
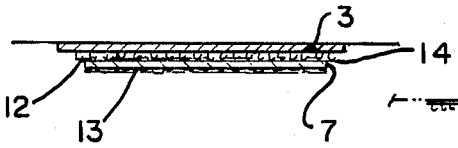
FIG. 6 is a sectional view of the lower edge of the shoe tongue, as applied to the shoe, as taken along the line 6—6 of FIG. 1.

As can be seen in FIG. 3, the tongue portion 7 may also contain a pocket portion, such as the laminar pocket 15, stitched or otherwise secured to its upper surface 9, in order to provide a pocket at that location for usage and application by the footwear wearer. As can be noted, the stitching is generally provided, as at 16, around the sides and lower portion of the laminar formed pocket 15, with the upper edge being relatively free, in the manner as can be seen in FIG. 3. This upper edge likewise may be secured to the footwear tongue, through the usage of another segment of hook and pile type of fastening means, as shown at 17. On the other hand, where the tongue portion may be fabricated of a pair of liners, such as those upper and lower liners 9 and 10, respectively, as previously explained, it is further likewise that the pocket may be integrated into the tongue portion itself, such as by a stitching of the tongue liners entirely around their sides and lower perimeters, but leaving the top edge, as at 18, opened, so as to provide access into the integral form of pocket that may be fabricated in this manner from the tongue portion itself As can be seen in FIG. 6, which is a top view of the tongue portion 7, the usage of the hook and pile style of fastening means, as shown at 17, along the upper edge of the shoe piece 3, is disclosed, and useful for holding the tongue 7 secured to the same. In addition, the arrangement of the pile 12 segment of the hook and pile fastening means, provided at the lower edge of the footwear tongue 7, is likewise disclosed.

Figure 7:
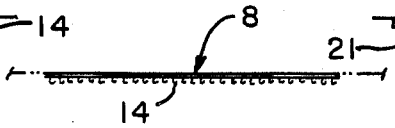
FIG. 7 is an edge view of the upper vamp of the footwear showing the hook segment of the connector means provided upon its interior surface and readily available for reception of the pile portion connecting with the lower end of the reversible footwear tongue.

Furthermore, FIG. 7 discloses that sectional view of just the toe piece 3, taken also generally along the vicinity of 6—6 of FIG. 1, and shows where the tongue portion through the application of its pile form of connector, attaches to the hook portion 14 of the fastening means, which is permanently secured to preferably the inner surface at the upper toe piece 8. But, it is just as likely that the tongue may adhere to the upper or external surface of the toe piece, as desired. This is a matter of choice.

Figure 8:
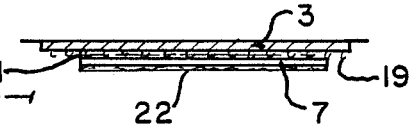
FIG. 8 is a sectional view of the upper vamp portion of the footwear and the reversible tongue taken along the line 8—8 of FIG. 2.

FIG. 8 discloses a sectional view taken along the line 8—8 of FIG. 2. This is quite similar to that which is shown in FIG. 6, but in this case is looking up along the location of the upper toe piece 3, of the upper vamp of the shown high top shoe, and at which location incorporates a permanent attachment of the hook portion of the hook and pile fastening means, as at 19. In addition, the reversible tongue 7 proximate its lower edge, once again includes the arrangement of the pile portion of the hook and pile fastening means, as at 21 and 22, upon both its upper and lower surfaces, so as to provide for attachment of the tongue 7 to the inner surface of the toe piece, and which tongue, because it incorporates the pile fastening means upon both of its upper and lower bottom edge surfaces, can be reversed in its attachment thereto, so as to provide a display of a plurality of indicia or coloring, in the manner as previously explained.

In principle, as previously summarized, the significance of this invention is to provide a tongue portion that can be adhered through the use of hook and pile style fastening means to the upper edge of the toe piece, be reversed in its installation, so as to display a variety of indicia, such as coloring, as desired. In addition, the tongue may be fabricated of an integral piece of material, and have a laminar pocket applied thereon, or be constructed of various liners of material, and have the pocket integrally formed intermediately thereof.

Variations or modifications to the subject matter of this invention may occur to those skilled in the art upon reviewing the description of the invention as provided herein. Such variations, if within the spirit of this invention, are intended to be encompassed within the scope of any claims to patent protection issuing hereon The description of the preferred embodiment set forth herein is done so for illustrative purposes only.

Having thus described the invention what is claimed and desired to be secured by Letters Patent is:

1. In the construction of footwear of the type having a vamp, toe piece, quarter portions, and counters, all integrated together to form a shoe upper, and secured to a shoe sole, the improvement which comprises, a tongue portion, said tongue portion having upper and lower surfaces, said tongue portion removably securing to the toe piece, said toe piece having an upper edge, fastening means holding said tongue portion to the toe piece at its upper edge, said fastening means comprising a hook and pile fastening means, wherein at least one of said hook and pile fastening means securing with the upper edge of the shoe toe piece, and the other of said hook and pile fastening means securing with the lower edges of both the upper and lower surfaces of the tongue portion, the hook and pile fastening means connecting with both said lower edge of the tongue portion and with the upper edge of the toe piece extending for the full width of the tongue portion lower edge, and said tongue portion being removable and reversible in its securement with the said toe piece.

2. The invention of claim 1 and wherein said reversible tongue portion containing a pocket.

3. The invention of claim 2 and wherein said pocket being contained within the tongue portion.

4. The invention of claim 2 and wherein said pocket formed as a laminar pocket applied upon the surface of the tongue portion.

5. The invention of claim 2 and wherein there being a pair of said pockets incorporated in said reversible tongue, each pocket formed as a laminar pocket, and one of each pocket being applied upon both the upper and lower surfaces of the reversible tongue portion.

6. The invention of claim 5 and wherein said tongue portion formed of upper and lower liners, and each of said liners possessing differing indicia for display when said tongue portion is revered in its attachment with the toe piece.

7. The invention of claim 6 and wherein said differing indicia comprising different colors.

8. The invention of claim 6 and wherein the differing indicia comprising different designs.

* * * * *